United States Patent [19]

Christen

[11] 4,029,319

[45] June 14, 1977

[54] ARROWHEAD ASSEMBLY HAVING DETACHABLE LOCKING MEANS

[75] Inventor: Jack P. Christen, Onalaska, Wis.

[73] Assignee: Outers Laboratories, Inc., Onalaska, Wis.

[22] Filed: Apr. 16, 1976

[21] Appl. No.: 677,559

[52] U.S. Cl. ..... 273/106.5 B; 30/329; 30/332; 279/42; 279/48

[51] Int. Cl.[2] ..... F41B 5/02

[58] Field of Search ..... 273/106.5 R, 106.5 B; 279/48, 42; 30/329, 332

[56] References Cited

UNITED STATES PATENTS

| | | | |
|---|---|---|---|
| 207,620 | 9/1878 | Parmelee | 279/48 X |
| 2,250,237 | 7/1941 | Schwartzkopf | 30/332 X |
| 2,289,284 | 7/1942 | Chandler | 273/106.5 B |
| 2,634,775 | 4/1953 | Unsinger | 279/42 X |
| 2,912,247 | 11/1959 | Doonan | 273/106.5 B |
| 3,614,103 | 10/1971 | Carroll | 273/106.5 B |
| 3,741,542 | 6/1973 | Karbo | 273/106.5 B |
| 3,868,114 | 2/1975 | Groner | 273/106.5 B |
| 3,910,579 | 10/1975 | Sprandel | 273/106.5 B |

*Primary Examiner*—Paul E. Shapiro
*Attorney, Agent, or Firm*—James E. Nilles

[57] ABSTRACT

An arrowhead fabricated from two separate blades arranged at cross angles to one another and held in position by a collet, the collet having a cooperating cam sleeve for detachably locking the blades together in a rigid manner. A threaded insert is provided for the collet by means of which the latter can be removed from and attached to the arrow shaft and provides for withdrawing the arrowhead assembly from the game and for disassembly of the arrowhead for sharpening or repair purposes.

3 Claims, 6 Drawing Figures

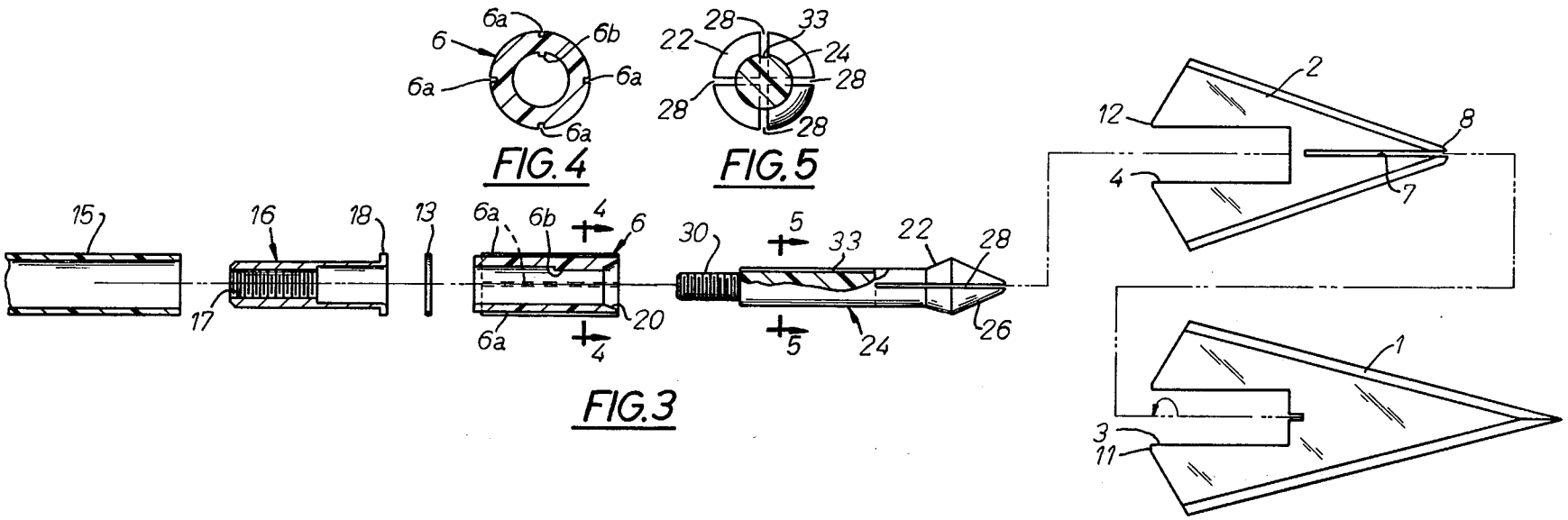
FIG. 3
FIG. 4
FIG. 5
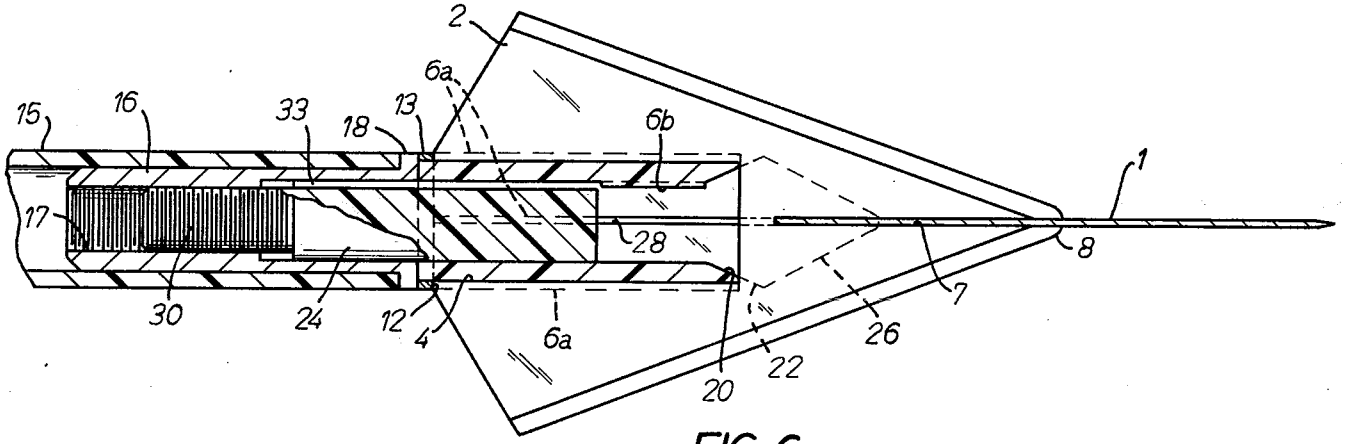
FIG. 6

ARROWHEAD ASSEMBLY HAVING DETACHABLE LOCKING MEANS

BACKGROUND OF THE INVENTION

Composite arrowheads have been proposed which utilize two separate blades usually made of spring steel and which are inserted together at right angles by means of interlocking slots. Various devices have been proposed for holding the blades in assembled relationship with one another and with the supporting shaft but these have usually proven to be expensive to manufacture and not entirely rigid and secure in their fastening function. Furthermore, they have been difficult, if not impossible to remove from the game without damage to the arrowhead and have also been difficult to disassemble for sharpening or repair purposes.

Examples of the prior art devices of this general character are shown in the following U.S. Pat. No. 2,676,017 issued Apr. 20, 1954 to Selent et al., U.S. Pat. No. 2,816,766 issued Dec. 17, 1957 to Stockfleth; U.S. Pat. No. 2,829,894 issued Apr. 8, 1958 to Henkel; U.S. Pat. No. 2,909,372 issued Oct. 20, 1959 to Neri; U.S. Pat. No. 2,912,247 issued Nov. 10, 1959 to Doonan; and U.S. Pat No. 2,685,055 issued Aug. 10, 1954 to Peltz.

SUMMARY OF THE INVENTION

The present invention provides a composite arrowhead having a pair of blades that are detachably secured together at right angles and which are locked in position with one another and in detachable connection with the shaft by means of a collet and cooperating cam sleeve. The arrangement is such that the collet maintains the blades at a proper right angle relationship to one another and furthermore tightly grasps the blades when the cam sleeve is drawn up tight against the collet and when the latter is threadably engaged in the inside of the shaft. The arrangement is such that the blade assembly can be disassembled from the shaft and can be further taken apart for re-sharpening of the blades or replacement or repair of the blade assembly parts.

These and other objects and advantages of the present invention will appear hereinafter as this disclosure progresses, reference being had to the accompanying drawings.

THE DRAWINGS

FIG. 3 is a side elevational, exploded view, showing certain of the parts in section of the arrowhead assembly;

FIG. 4 is a sectional view taken along line 4—4 in FIG. 3, but on an enlarged scale;

FIG. 5 is a sectional view taken along 5—5 in FIG. 3, but on an enlarged scale; and FIG. 6 is a side elevational view of the arrowhead assembly in assembled relationship, the view being in cross section and showing parts being broken away for the sake of clarity.

DESCRIPTION OF A PREFERRED EMBODIMENT

Figure 1:
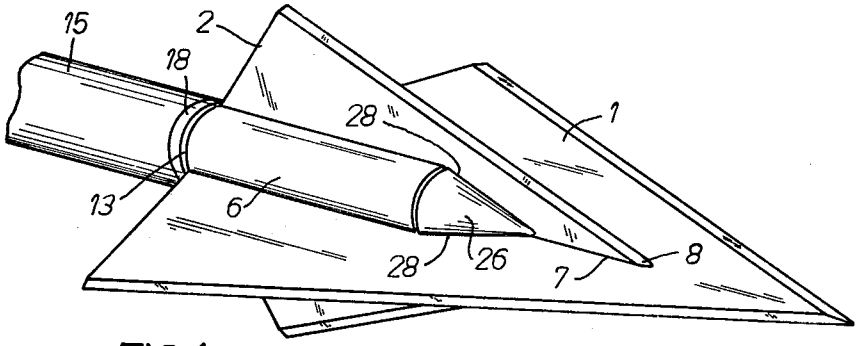
FIG. 1 is a fragmentary view of an arrowhead assembly made in accordance with the present invention.
Figure 2:
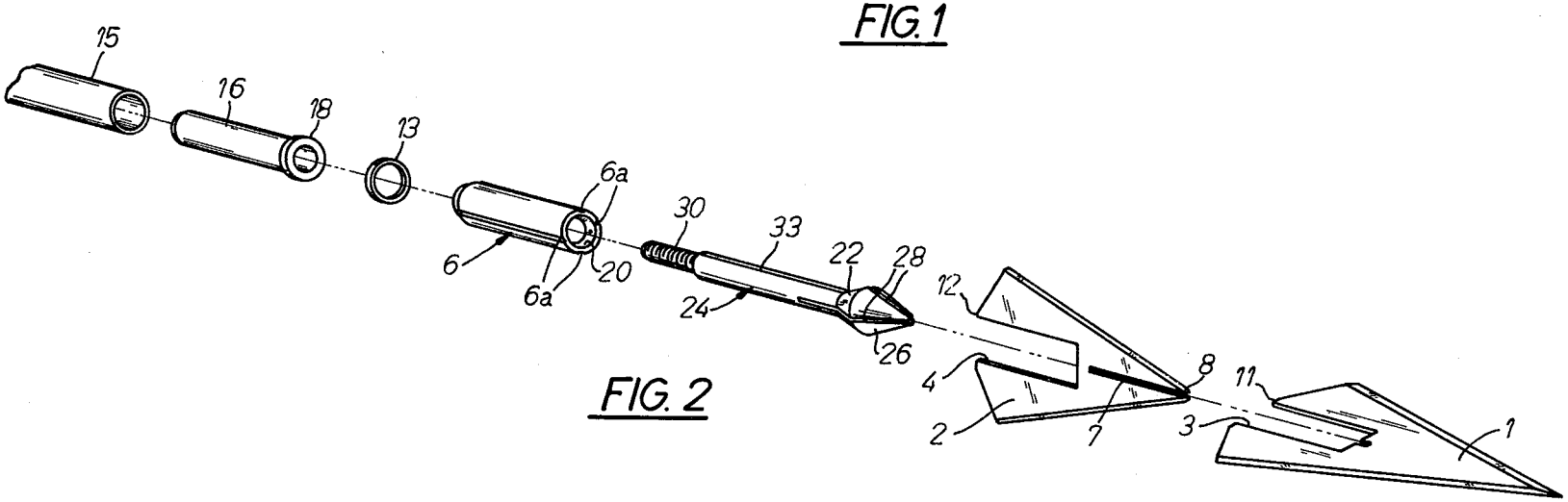
FIG. 2 is an exploded, perspective view of the assembly shown in FIG. 1 but on a reduced scale.

The arrowhead assembly provided by the present invention includes a main blade 1 and a secondary blade 2, both of which are formed of spring steel and both of which have central, rectangularly shaped recesses 3 and 4 respectively which receive a sleeve 6 to be further described. Blade 2 has a central, axially extending slot 7 that extends from its point 8 and into the body of the blade. Blade 1 is adapted to be positioned at a right angle to blade 2 as shown in FIG. 1 and the blade 1 is inserted in the slot 7 of the secondary blade 2. This positions the blades at right angles to one another as shown in FIG. 2. Both blades have sharp edges along both of their sides which can be periodically resharpened as needed. Both blades 1 and 2 have rear edges 11 and 12, respectively, which abut against a steel impact ring 13 to be later referred to.

The shaft 15 of the arrow may be made of fiberglass and is rigid and its forward end receives a steel insert 16 which has an internal thread 17 and a forward, radially extending flange 18. The insert is adapted to be fixed, as by gluing in shaft 15. The impact ring 13 is adapted to bear against the forward side of the flange 18 when in the assembled position shown in FIG. 6. The sleeve 6 has four circumferentially spaced, axially extending slots **6*a* along its length. The sleeve also has an internal, axially extending ridge 6*b*. Furthermore, the sleeve has a forwardly facing, tapered opening 20 which forms a cam surface that can abut tightly against a corresponding cam surface 22 of the collet 24** now to be referred to.

The collet 24 is preferably made of plastic as is the sleeve 6 and has a forward, conical shaped end 26 that extends from the rearwardly and inwardly inclined cam surface 22. The collet furthermore has four equally and circumferentially spaced slots 28 extending in an axial direction for a certain portion of its length as shown in FIG. 3. These slots 28 are adapted to receive the forward portions of the blades 1 and 2 and act to hold the blades in right angled relationship with one another. The forward, conical shaped portion 26, as shown in FIG. 1, acts to form a smooth entry end for the collet. The collet furthermore has a rear threaded portion 30 that is threadably engageable in the internal thread 17 of the insert 16.

Means are provided between the sleeve and the collet for insuring that the axial slots **6*a* of the sleeve are maintained in registry with the axial slots 28 of the collet so that both slots are in axial alignment for the reception of their respective blades 1 and 2. This assurance for alignment comprises a small groove 33 extending axially on the periphery of the collet (FIGS. 3 and 5) which slideably receives the internal ridge 6*b* of the sleeve 6, thus relative rotation between the sleeve and the collet is precluded and axial alignment of the slots 6*a* of the sleeve and slots 28** of the collet is assured.

When in the assembled position shown in FIG. 6, the rear ends 11 and 12 of blades 1 and 2 abut against the steel impact ring 13, the collet has been rightly threaded into the insert 16, thus forcing the tapered cam surface 20 of the sleeve to bear tightly against the complementary tapered surface 22 of the collet, thus causing the four front end portions of the collet to be radially forced inwardly together and tightly against the blades thereby rigidly holding the blades in the collet grip.

I claim:

1. A removable arrowhead assembly comprising at least one blade having a recess extending inwardly from the rear edge thereof, a collet having at least one axial slot for the reception of said blade therein, said collet also having a cam surface and a threaded rearward end, a sleeve accommodated by said recess in said blade and having a cam surface adapted to abut against said cam surface of said collet for causing said collet to clamp tightly against said blade, said sleeve having at least one axial slot on the exterior thereof in axial alignment with said one axial slot in said collet, said slot in said sleeve receiving said blade for rigidly holding the latter in relationship to said sleeve, means located on the inner surface of said sleeve and interengaging with means on the exterior surface of said collet for preventing relative rotation between said collet and said sleeve, an insert having an internal thread for the reception of the threaded end of said collet, said insert being adapted to be secured to an arrow shaft, a metal impact ring mounted around said collet, said blade bearing against said metal impact ring when in assembled relationship, whereby said collet can be inserted in said sleeve and threadably engaged in said insert to tightly draw said collet cam surface against said sleeve cam surface for causing locking engagement of said collet against said blade.

2. A removable arrowhead assembly comprising a pair of blades arranged at right angles to one another, said blades having a sleeve-receiving recess extending inwardly from the rear thereof, a collet having axial slots for the reception of said blades therein, said collet also having a cam surface and a threaded rearward end, a sleeve accommodated by said recess in said blade and having a cam surface adapted to abut against said cam surface of said collet for causing said collet to clamp tightly against said blades, said sleeve having axial slots on the exterior thereof in axial alignment with said axial slots in said collet, said slots receiving said blades for rigidly holding the latter in right angled relationship to one another, means located on the inner surface of said sleeve and interengaging with means on the exterior surface of said collet for preventing relative rotation between said collet and said sleeve, an insert having an internal thread for the reception of the thread and of said collet, said insert being adapted to be secured to an arrow shaft, a metal impact ring mounted around said collet, said blades bearing against said metal impact ring when in assembled relationship, whereby said collet can be inserted in said sleeve and threadably engaged in said insert to tightly draw said collet cam surface against said sleeve cam surface for causing locking engagement of said collet against said blades.

3. The assembly set forth in claim 2 wherein said pair of blades includes a main blade and a secondary blade and wherein said secondary blade includes a slot extending rearwardly from the point thereof whereby said blades can be interengaged at right angles, and wherein each blade has a recess extending inwardly from the rear thereof, which recesses cooperate to define said sleeve-receiving recess.

* * * * *